US005954749A

United States Patent [19]

Fields et al.

[11] Patent Number: 5,954,749

[45] Date of Patent: Sep. 21, 1999

[54] MESH PACIFIER WITH ATTACHMENT CLIP

[75] Inventors: Valerie M. Fields, Woodstock; Greg Yehl, Snellville, both of Ga.

[73] Assignee: Evenflo Company, Inc., Vandalia, Ohio

[21] Appl. No.: 08/854,790

[22] Filed: May 12, 1997

[51] Int. Cl.[6] ..... A61J 17/00

[52] U.S. Cl. ..... 606/234; D24/194

[58] Field of Search ..... 606/235, 234, 606/236; D24/194–199

[56] References Cited

U.S. PATENT DOCUMENTS 4,765,037 8/1988 Perry ..... 606/234

5,156,617 10/1992 Reid ..... 606/234

5,334,218 8/1994 Johnson ..... 606/235

5,403,349 4/1995 Rohrig ..... 606/234

*Primary Examiner*—Michael H. Thaler

*Attorney, Agent, or Firm*—Thompson Hine & Flory LLP

[57] ABSTRACT

A mesh pacifier and associated clip attachment including a shield comprised of a peripheral rim dimensioned for surrounding a mouth of a baby. A nipple portion extends forwardly from the shield. A handle portion extends rearwardly from the shield. A plurality of sections of apertures are formed through the shield.

11 Claims, 3 Drawing Sheets

FIG 1
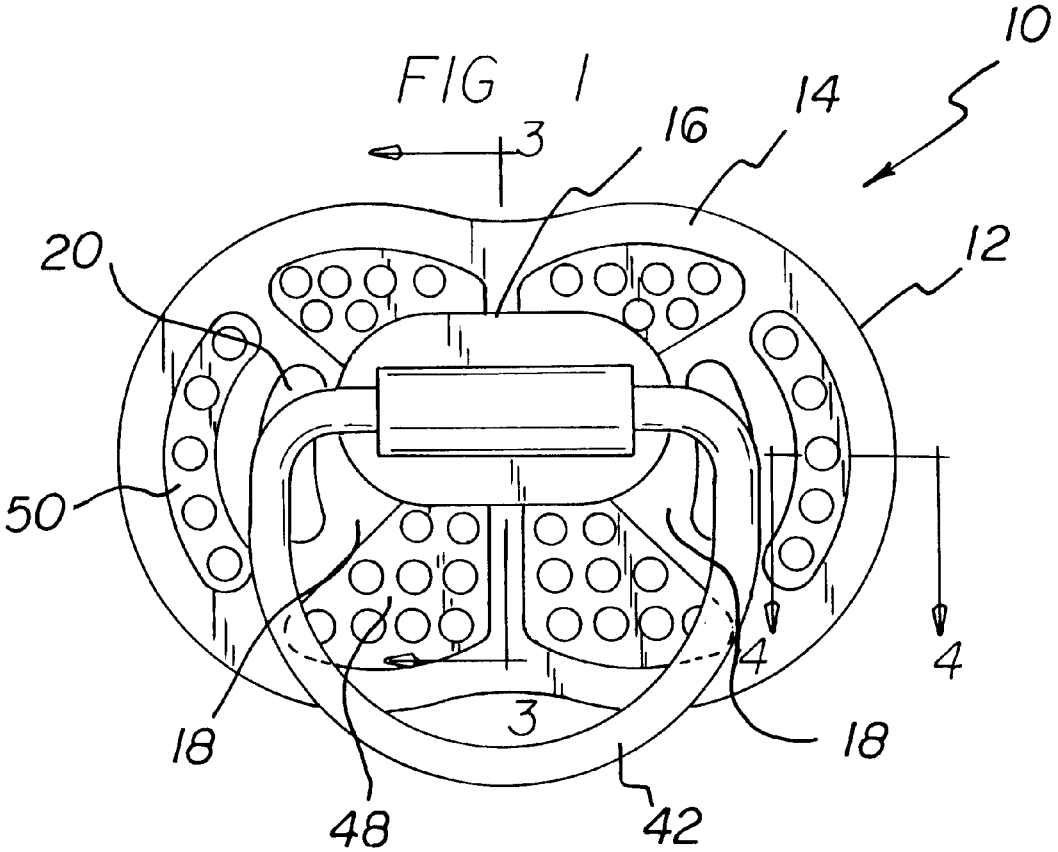
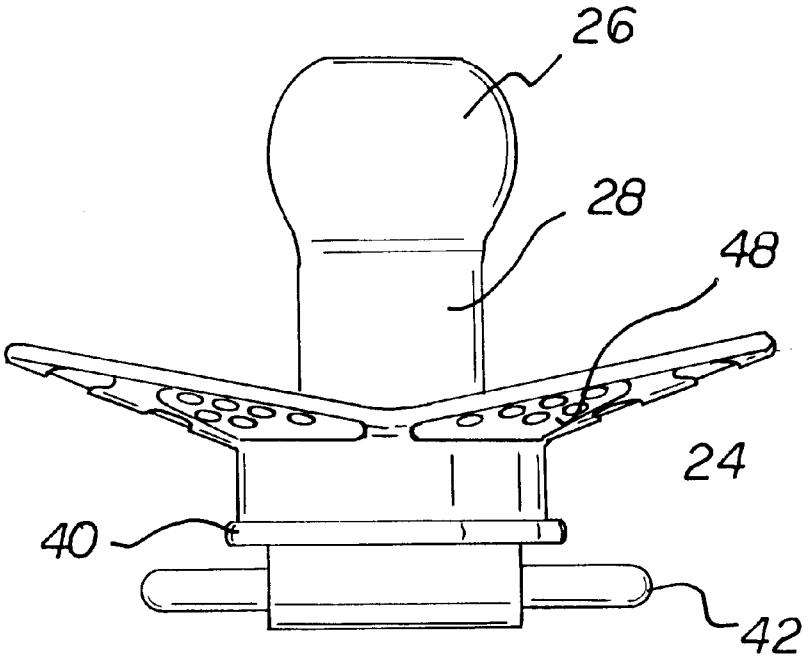
FIG 2

MESH PACIFIER WITH ATTACHMENT CLIP

BACKGROUND OF THE INVENTION

1. Field of the Invention

The present invention relates to a mesh pacifier and associated clip attachment and more particularly pertains to creating air circulation around a baby's mouth while in use and securing to clothes of the baby with a mesh pacifier and associated clip attachment.

2. Description of the Prior Art

The use of pacifiers is known in the prior art. More specifically, pacifiers heretofore devised and utilized for the purpose of providing palatal stimulation are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,578,058 to Chen discloses a hygienic pacifier shielded with bivalve shell. U.S. Pat. No. 5,459,903 to Treacy discloses a method and apparatus for supporting an item proximate to a person's mouth. U.S. Pat. No. 5,391,184 to Rosenthal discloses a pacifier system for infants. U.S. Pat. No. 5,156,617 to Reid discloses a pacifier cover. U.S. Pat. No. 4,994,075 to Smith et al. discloses an infant pacifier holder assembly. U.S. Pat. No. 4,990,157 to Roberts et al. discloses a soother retainer. U.S. Pat. No. 4,765,037 to Perry discloses a pacifier strap. U.S. Pat. No. Des. 276,939 to Pascoe discloses the ornamental design for a baby pacifier with cord. U.S. Pat. No. 3,392,729 to Lenoir discloses a fastener with flexible cord or the like for securing a pacifier to a garment.

While these devices fulfill their respective, particular objective and requirements, the aforementioned patents do not describe a mesh pacifier and associated clip attachment for creating air circulation around a baby's mouth while in use and securing to clothes of the baby.

In this respect, the mesh pacifier and associated clip attachment according to the present invention substantially departs from the conventional concepts and designs of the prior art, and in doing so provides an apparatus primarily developed for the purpose of creating air circulation around a baby's mouth while in use and securing to clothes of the baby.

Therefore, it can be appreciated that there exists a continuing need for a new and improved mesh pacifier and associated clip attachment which can be used for creating air circulation around a baby's mouth while in use and securing to clothes of the baby. In this regard, the present invention substantially fulfills this need.

SUMMARY OF THE INVENTION

In the view of the foregoing disadvantages inherent in the known types of pacifiers now present in the prior art, the present invention provides an improved mesh pacifier and associated clip attachment. As such, the general purpose of the present invention, which will be described subsequently in greater detail, is to provide a new and improved mesh pacifier and associated clip attachment and method which has all the advantages of the prior art and none of the disadvantages.

To attain this, the present invention essentially comprises a shield comprised of a peripheral rim dimensioned for surrounding a mouth of a baby. The peripheral rim has a central divider extending longitudinally therebetween to divide the shield into two side portions. Each of the two side portions have a large oblong channel extending therethrough. A nipple portion extends forwardly from the central divider of the shield. A handle portion extends rearwardly from the central divider of the shield. A plurality of sections of apertures formed through the shield. The sections of apertures include two generally triangular sections adjacent to the central divider and an arcuate section disposed in each of the two side portions of the shield. An attachment clip couples the pacifier with respect to an article of clothing of a baby. The attachment clip includes a strap having a first end having separate portions of hook and loop fasteners thereon for securement of the strap to the handle. A second end of the strap has a circular disk secured thereto. The circular disk has a spring clip on an interior side thereof for coupling with the clothing of the baby.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mesh pacifier and associated clip attachment which has all the advantages of the prior art pacifiers and none of the disadvantages.

It is another object of the present invention to provide a new and improved mesh pacifier and associated clip attachment which may be easily and efficiently manufactured and marketed.

It is a further object of the present invention to provide a new and improved mesh pacifier and associated clip attachment which is of durable and reliable construction.

An even further object of the present invention is to provide a new and improved mesh pacifier and associated clip attachment which is susceptible of a low cost of manufacture with regard to both materials and labor, and which accordingly is then susceptible of low prices of sale to the consuming public, thereby making such a mesh pacifier and associated clip attachment economically available to the buying public.

Even still another object of the present invention is to provide a new and improved mesh pacifier and associated clip attachment for creating air circulation around a baby's mouth while in use and securing to clothes of the baby.

Lastly, it is an object of the present invention to provide a new and improved mesh pacifier and associated clip attachment including a shield comprised of a peripheral rim dimensioned for surrounding a mouth of a baby. A nipple portion extends forwardly from the shield. A handle portion extends rearwardly from the shield. A plurality of sections of apertures are formed through the shield.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a rear elevation view of the preferred embodiment of the mesh pacifier and associated clip attachment constructed in accordance with the principles of the present invention.

FIG. 2 is a top plan view of the present invention.

The same reference numerals refer to the same parts through the various figures.

DESCRIPTION OF THE PREFERRED EMBODIMENT

Figure 3:
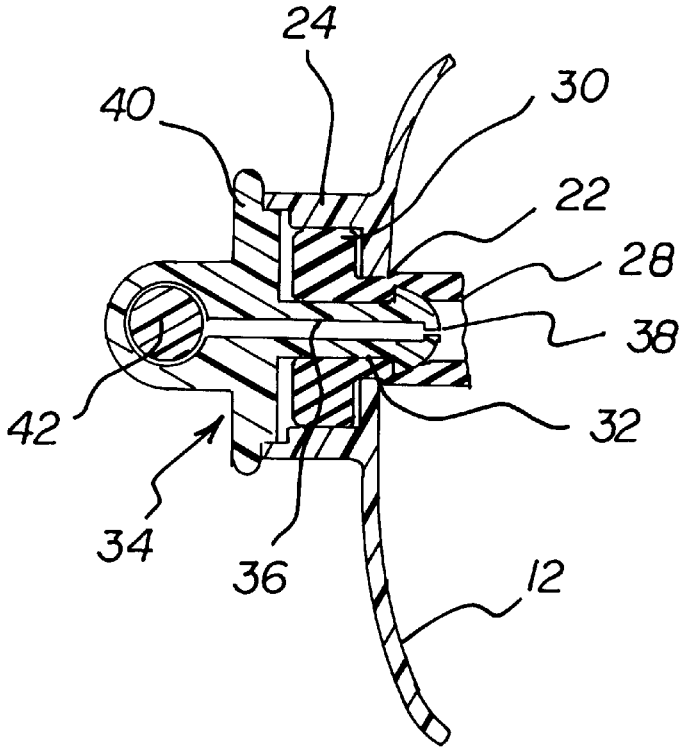
FIG. 3 is a cross-sectional view of the present invention as taken along line 3—3 of FIG. 1.
Figure 4:
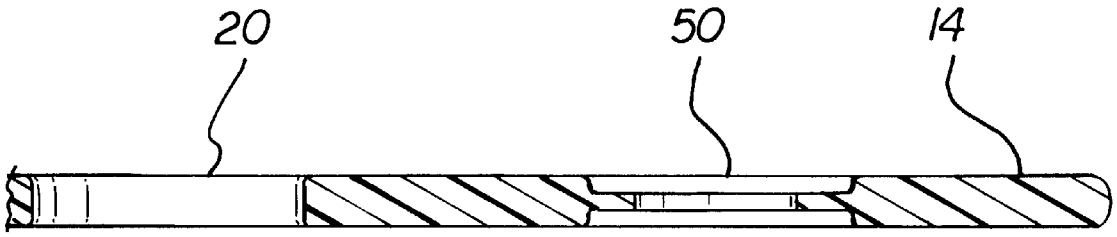
FIG. 4 is a cross-sectional view as taken along line 4—4 of FIG. 1.
Figure 5:
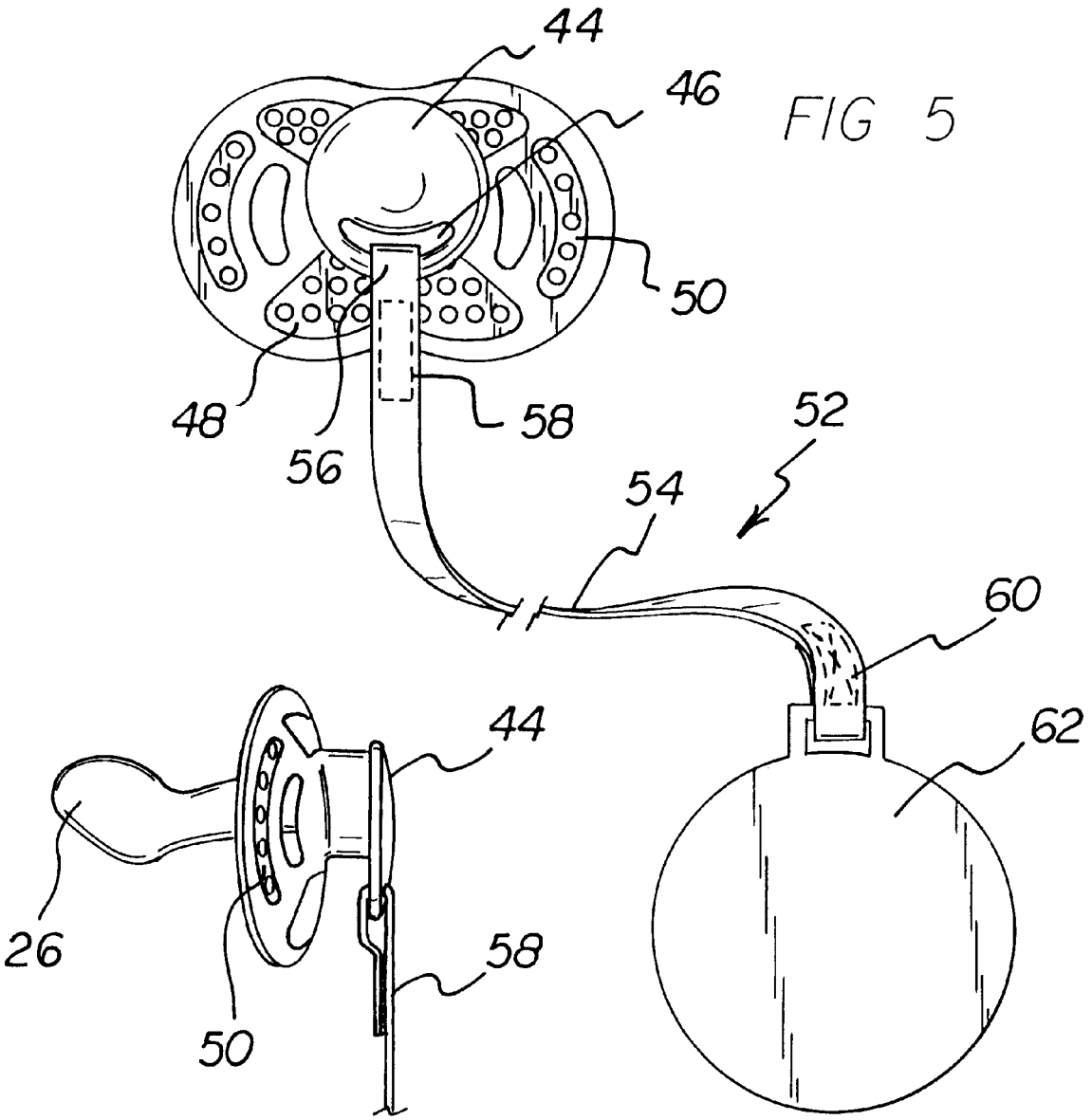
FIG. 5 is a front view of the pacifier and the clip attachment of the present invention.
Figure 6:
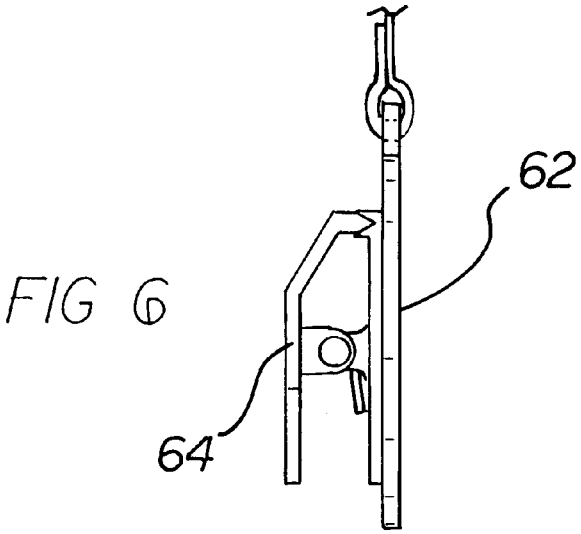
FIG. 6 is a side elevation view of the pacifier and the clip attachment of the present invention.

With reference now to the drawings, and in particular, to FIGS. 1 through 6 thereof, the preferred embodiment of the new and improved mesh pacifier and associated clip attachment embodying the principles and concepts of the present invention and generally designated by the reference number 10 will be described.

Specifically, it will be noted in the various Figures that the device relates to a mesh pacifier and associated clip attachment for creating air circulation around a baby's mouth while in use and securing to clothes of the baby. In its broadest context, the device consists of a shield, a nipple portion, a handle portion, a plurality of sections of apertures and a clip attachment. Such components are individually configured and correlated with respect to each other so as to attain the desired objective.

The device 10 includes a shield 12 comprised of a peripheral rim 14 dimensioned for surrounding a mouth of a baby. The peripheral rim 14 has a central divider 16 extending longitudinally therebetween to divide the shield 12 into two side portions 18. Each of the two side portions 18 have a large oblong channel 20 extending therethrough. The shield 12 includes a mounting aperture 22 through the central divider 16 and a circular flange 24 extending rearwardly from the shield 12. The circular flange 24 is disposed around the mounting aperture 22. The shield 12 is preferably fabricated of a molded plastic, such as polypropylene.

A nipple portion 26 extends forwardly from the central divider 16 of the shield 12. The nipple portion 26 includes a hollow shaft 28 extending through the aperture 22. The shaft 28 has a boss 30 disposed on a free end thereof with the boss 30 rotatably positioned within the circular flange 24. The boss 30 has a central aperture 32 therethrough.

A handle portion 34 extends rearwardly from the central divider 16 of the shield 12. The handle portion 34 includes an interior rod 36 extending through the central aperture 32 of the boss 30 and inwardly of the hollow shaft 28. A free end of the interior rod 36 has an engagement protrusion 38 disposed thereon to preclude disengagement of the handle portion 34 from the shield 12 and nipple 26. The handle portion 34 further includes a generally planar plate 40 secured to the circular flange 24. The planar plate 40 has a grasping ring 42 pivotally coupled thereto. Alternately, the handle portion 34 can include a generally curved plate 44 secured to the circular flange 24. The curved plate 44 has an arcuate recess 46 therethrough.

A plurality of sections of apertures are formed through the shield 12. The sections of apertures include two generally triangular sections 48 adjacent to the central divider 16 and an arcuate section 50 disposed in each of the two side portions 18 of the shield 12.

An attachment clip 52 couples the pacifier with respect to an article of clothing of a baby. The attachment clip 52 includes a strap 54 having a first end 56 having separate portions of hook and loop fasteners 58 thereon for securement of the strap 54 to the handle portion 34. The first end 56 is threaded through the grasping handle 42 or, alternately, through the arcuate recess 46. A second end 60 of the strap 54 has a circular disk 62 secured thereto. The circular disk 62 has a spring clip 64 on an interior side thereof for coupling with the clothing of the baby. The circular disk could additionally be provided with indicia on the exterior surface.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A mesh pacifier and associated clip attachment for creating air circulation around a baby's mouth while in use and securing to clothes of the baby comprising, in combination:

a shield comprised of a peripheral rim dimensioned for surrounding a mouth of a baby, the peripheral rim having a central divider extending longitudinally therebetween to divide the shield into two side portions, each of the two side portions having a large oblong channel extending therethrough;

a nipple portion extending forwardly from the central divider of the shield;

a handle portion extending rearwardly from the central divider of the shield;

a plurality of sections of apertures formed through the shield, the sections of apertures including two generally triangular sections adjacent to the central divider and an arcuate section disposed in each of the two side portions of the shield; and an attachment clip adapted to couple the pacifier with respect to an article of clothing of a baby, the attachment clip including a strap having a first end having separate portions of hook and loop fasteners thereon for securement of the strap to the handle, a second end of the strap having a circular disk secured thereto, the circular disk having a spring clip on an interior side thereof for coupling with the clothing of the baby.

2. The mesh pacifier as set forth in claim 1 wherein the shield further includes means for securing the nipple portion and the handle portion thereto.

3. The mesh pacifier as set forth in claim 2 wherein the means includes a mounting aperture through the central divider and a circular flange extending rearwardly from the shield, the circular flange being disposed around the mounting aperture.

4. The mesh pacifier as set forth in claim 3 wherein the nipple includes a hollow shaft extending through the aperture, the shaft having a boss disposed on a free end thereof with the boss rotatably positioned within the circular flange, the boss having a central aperture therethrough wherein the central aperture is contiguous with the hollow shaft.

5. The mesh pacifier as set forth in claim 4 wherein the handle portion includes an interior rod extending through the central aperture of the boss and inwardly of the hollow shaft, a free end of the interior rod having an engagement protrusion disposed thereon to preclude disengagement of the handle portion from the shield and nipple.

6. The mesh pacifier as set forth in claim 5 wherein the handle portion further includes a generally planar plate secured to the circular flange, the planar plate having a grasping ring pivotally coupled thereto.

7. The mesh pacifier as set forth in claim 5 wherein the handle portion includes a generally curved plate secured to the circular flange, the curved plate having an arcuate recess therethrough.

8. A mesh pacifier for creating air circulation around a baby's mouth while in use comprising, in combination:

a shield comprised of a peripheral rim dimensioned for surrounding a mouth of a baby;

a nipple portion extending forwardly from the shield;

a handle portion extending rearwardly from the shield; and a plurality of sections of apertures formed through the shield and wherein the sections of apertures includes two generally triangular sections and an arcuate section disposed in each of two side portions of the shield.

9. The mesh pacifier as set forth in claim 8 and further including an attachment clip adapted to couple the pacifier with respect to an article of clothing of a baby, the attachment clip including a strap having a first end having separate portions of hook and loop fasteners thereon for securement of the strap to the handle, a second end of the strap having a circular disk secured thereto, the circular disk having a spring clip on an interior side thereof for coupling with the clothing of the baby.

10. The mesh pacifier as set forth in claim 8 wherein the shield is further defined by a central divider extending longitudinally between the shield to divide the shield into two side portions, each of the two side portions having a large oblong channel extending therethrough.

11. A device for coupling a pacifier to a portion of a person's clothing comprising:

an attachment clip adapted to couple the pacifier with respect to the portion of clothing, the attachment clip including a strap having a first end having separate portions of hook and loop fasteners thereon for securement of the strap to the article, a second end of the strap having a circular disk secured thereto, the circular disk having a spring clip on an interior side thereof for coupling with the portion of clothing and wherein the pacifier includes a shield comprised of a peripheral rim dimensioned for surrounding a mouth of a baby;

a nipple portion extending forwardly from the shield;

a handle portion extending rearwardly from the shield; and a plurality of sections of apertures formed through the shield wherein the sections of apertures includes two generally triangular sections and an arcuate section disposed in each of two side portions of the shield.

* * * * *